US009592619B2

(12) United States Patent
Rohrer et al.

(10) Patent No.: US 9,592,619 B2
(45) Date of Patent: Mar. 14, 2017

(54) DEVICE FOR PROCESSING OR GENERATING BREAK LINES IN FLAT PRODUCTS

(75) Inventors: Hans-Peter Rohrer, Moehlin (CH); Claus Lautz, Orselina (CH); Hans Peter, Herznach (CH)

(73) Assignee: PANTEC AG, Stansstad (CH)

( * ) Notice: Subject to any disclaimer, the term of this patent is extended or adjusted under 35 U.S.C. 154(b) by 166 days.

(21) Appl. No.: 13/816,113

(22) PCT Filed: Jun. 14, 2011

(86) PCT No.: PCT/EP2011/059816

§ 371 (c)(1),
(2), (4) Date: Feb. 8, 2013

(87) PCT Pub. No.: WO2012/019808

PCT Pub. Date: Feb. 16, 2012

(65) Prior Publication Data

US 2013/0133499 A1 May 30, 2013

(30) Foreign Application Priority Data

Aug. 9, 2010 (DE) ..... 10 2010 039 094
Nov. 15, 2010 (DE) ..... 10 2010 043 895

(51) Int. Cl.

| | |
|---|---|
| ***B26D 3/08*** | (2006.01) |
| ***B26D 7/08*** | (2006.01) |
| ***B26F 1/40*** | (2006.01) |
| *B26F 1/18* | (2006.01) |

(52) U.S. Cl.

CPC ..... *B26D 7/086* (2013.01); *B26D 3/08* (2013.01); *B26F 1/40* (2013.01); *B26F 1/18* (2013.01); *B31B 2201/252* (2013.01); *Y10T 83/8874* (2015.04)

(58) Field of Classification Search

CPC . B29C 43/00; B29C 2043/3636; B29C 65/08; B29C 65/083; B29C 65/085; B29C 65/087; B29C 65/088; B26D 7/086; B26D 3/08; B26F 1/40

USPC ..... 83/13, 956, 875, 880, 40, 55, 25

See application file for complete search history.

(56) References Cited

U.S. PATENT DOCUMENTS 1,322,525 A * 11/1919 Bowers ..... 83/685
3,874,963 A * 4/1975 Barger ..... B29C 65/08 156/580.1
4,500,372 A * 2/1985 Mion ..... B26D 7/086 156/251

(Continued)

FOREIGN PATENT DOCUMENTS

CH 628 564 A5 3/1982
CH 628564 A5 * 3/1982

(Continued)

*Primary Examiner* — Jason Daniel Prone
*Assistant Examiner* — Richard Crosby, Jr.
(74) *Attorney, Agent, or Firm* — Henry M. Feiereisen LLC

(57) ABSTRACT

In a device for processing flat products using a processing tool which processes the product between the tool and a counter-tool, the processing tool is supported by an ultrasonic sonotrode. The processing tool performs a processing movement together with an ultrasonic sonotrode, wherein the processing movement results in a partial separation of the flat product.

5 Claims, 4 Drawing Sheets

(56) References Cited

U.S. PATENT DOCUMENTS

| | | | | | |
|---|---|---|---|---|---|
| 4,560,427 | A * | 12/1985 | Flood | B29C 65/08 | 156/250 |
| 5,476,570 | A * | 12/1995 | Widmann | B06B 3/00 | 156/515 |
| 5,735,984 | A * | 4/1998 | Hoff | B29C 59/046 | 156/253 |
| 6,336,803 | B1 * | 1/2002 | Funger | B01J 19/10 | 156/580.2 |
| 6,588,477 | B2 * | 7/2003 | Habeck | C03B 33/078 | 156/257 |
| 6,676,003 | B2 * | 1/2004 | Ehlert | B23K 20/103 | 228/1.1 |
| 7,047,858 | B2 * | 5/2006 | Rohrer et al. | 83/582 | |
| 7,047,859 | B2 * | 5/2006 | Ide | B26D 7/018 | 264/155 |
| 7,097,727 | B2 * | 8/2006 | Podominick | B65H 37/04 | 156/250 |
| 7,776,171 | B2 * | 8/2010 | Lehto | B29C 66/92611 | 156/351 |
| 8,177,931 | B2 * | 5/2012 | Zawadzki | B26D 7/18 | 156/247 |
| 8,951,032 | B2 * | 2/2015 | Wittmaier | B23K 20/10 | 425/174.2 |
| 9,296,255 | B2 * | 3/2016 | Vogler | B06B 3/00 | |
| 2002/0197345 | A1 * | 12/2002 | Kubik et al. | 425/174.2 | |
| 2003/0188616 | A1 * | 10/2003 | Behymer | B26F 1/44 | 83/613 |
| 2006/0071057 | A1 | 4/2006 | Aschenbrenner et al. | | |
| 2007/0084322 | A1 * | 4/2007 | Williams | 83/13 | |
| 2007/0251362 | A1 * | 11/2007 | Vogler | 83/13 | |
| 2010/0084188 | A1 * | 4/2010 | Rajvanshi et al. | 174/666 | |
| 2013/0153115 | A1 * | 6/2013 | Wein | B29C 65/08 | 156/64 |
| 2015/0136307 | A1 * | 5/2015 | Scheu | B29C 65/081 | 156/73.1 |

FOREIGN PATENT DOCUMENTS

| | | | |
|---|---|---|---|
| DE | 36 03 627 | A1 | 4/1987 |
| DE | 4101545 | A1 * | 7/1992 |
| DE | 295 03 122.0 | U1 | 6/1995 |
| DE | 4439284 | A1 * | 4/1996 |
| DE | 201 14 860 | U1 | 2/2002 |
| DE | 20 2005 000 643 | U1 | 7/2005 |
| DE | 103 59 036 | B4 | 7/2005 |
| DE | 10 2004 050 686 | A1 | 4/2006 |
| DE | 10 2008 016 916 | A1 | 10/2009 |
| EP | 1 849 569 | A2 | 10/2007 |
| FR | 2 619 339 | A1 | 2/1989 |
| JP | S63-283895 | | 11/1988 |
| JP | H5-19198 | | 3/1993 |
| JP | 2001-062786 | | 3/2001 |
| JP | 2002-144287 | | 5/2002 |
| JP | 2002-337094 | | 11/2002 |
| JP | 2006-524580 | | 11/2006 |
| WO | WO01/41984 | A1 | 6/2001 |

* cited by examiner

DEVICE FOR PROCESSING OR GENERATING BREAK LINES IN FLAT PRODUCTS

CROSS-REFERENCES TO RELATED APPLICATIONS

This application is the U.S. National Stage of International Application No.PCT/EP2011/059816, filed Jun. 14, 2011, which designated the United States and has been published as International Publication No. WO 2012/019808 and which claims the priority of German Patent Applications, Serial No. 10 2010 039 094.1, filed Aug. 9, 2010, and Serial No. 10 2010 043 895.2, filed Nov. 15, 2010, pursuant to 35 U.S.C. 119(a)-(d).

BACKGROUND OF THE INVENTION

The invention relates to a device for processing or generating break lines in flat products using a processing tool, which processes the product between the processing tool and a counter tool.

For example, the packaging in the food, cosmetic and pharmaceutical industry often consists of laminates. The packaging must be placed in the desired shape when the containers are manufactured; to this end, the packaging must, inter alia, be processed, in particular separated. Processing should be done with little wear in order to protect the tools and workpieces. A typical composite film is composed of a base film, which may consist, for example, of polyamide (PA), polyester (PES), polyethylene terephthalate (PET), polypropylene (PP), polystyrene (PS), polyvinyl chloride (PVC), and an integrated barrier layer protecting against the penetration of oxygen, water, fats and UV radiation. Such a barrier layer may be, for example, ethylene vinyl alcohol (EVOH), a thermoplastic material or an aluminum foil. The film composite typically also includes a cover sheet made, for example, of PET, PP, or a composite, for example with aluminum foil. Other materials are aluminum, paper laminate, paper, corrugated paper and even fabric panels.

DE 103 59 036 B4 discloses a method for welding cups. DE 36 03 627 A1 and DE 201 14 860 U1 disclose a method for incorporating openings in containers. DE 10 2008 016 916 A1 discloses a device for cutting workpieces. DE 295 03 122 U1 discloses a sonotrode.

SUMMARY OF THE INVENTION

It is the object of the invention to further develop a processing device of the aforementioned type such that with the processing operation, the product attains an advantageous characteristic, wherein the processing operation can be carried with less wear or with a smaller applied force.

This object is attained according to the invention with a device of the aforementioned type in that the processing tool is supported by an ultrasonic sonotrode, and in that the processing tool, together with the ultrasonic sonotrode executes the processing movement, wherein the processing movement involves partial severing the flat product.

With the inventive device, the primary cutting movement of the processing tool, such as the punch or cutter, supplemented with an additional movement. This additional movement is produced by the ultrasonic sonotrode, to which the processing tool is attached. In this way, the products, also including laminates, can be reliably cut or punched with higher deformation capacity. This is done with the inventive device by applying reduced forces. The important advantage is that the flat product is additionally embrittled in the region in which it was processed. The flat product, which is for example a highly flexible film, can then be easily cut at the processed location by a deformation, for example, by bending. In conventionally processed films, the processed location is also deformed and does not break, because the weakened location is still flexible and elastic. Such a rated break point is impossible or at least difficult to break in two A preferred application of the invention is in knick-pack packaging, for example, for yogurt with cereal or in highly flexible, pliable films, such as transparent films.

A linear movement is regarded as advantageous processing movement of the processing tool. The ultrasound sonotrode performs an oscillating movement in a direction parallel to the working motion, and is superimposed on the working motion. The device of the invention thus performs a linear main movement superimposed on a linear oscillatory secondary motion in the cutting direction produced by ultrasound. Oscillation amplitudes from 5 μm to 20 μm are produced and transferred to the cutting edge.

The surface oscillations at the cutting edge serve to soften the laminate in the cutting zone and help to prevent a distortion of the material before the separation tear is introduced. An occasional separation of material particles from the laminate due to adhesive binding on the cutting tool (fiber formation), which frequently occurs in conventional cutting, can thus be prevented.

BRIEF DESCRIPTION OF THE DRAWING

Further advantages, features and details of the invention will become apparent from the following description in which a particularly preferred embodiment is described in detail with reference to the drawing. Here, the features shown in the drawing and mentioned in the description and in the claims can each be essential for the invention either severally or in any combination.

In the drawings.

DETAILED DESCRIPTION OF PREFERRED EMBODIMENTS

Figure 1:
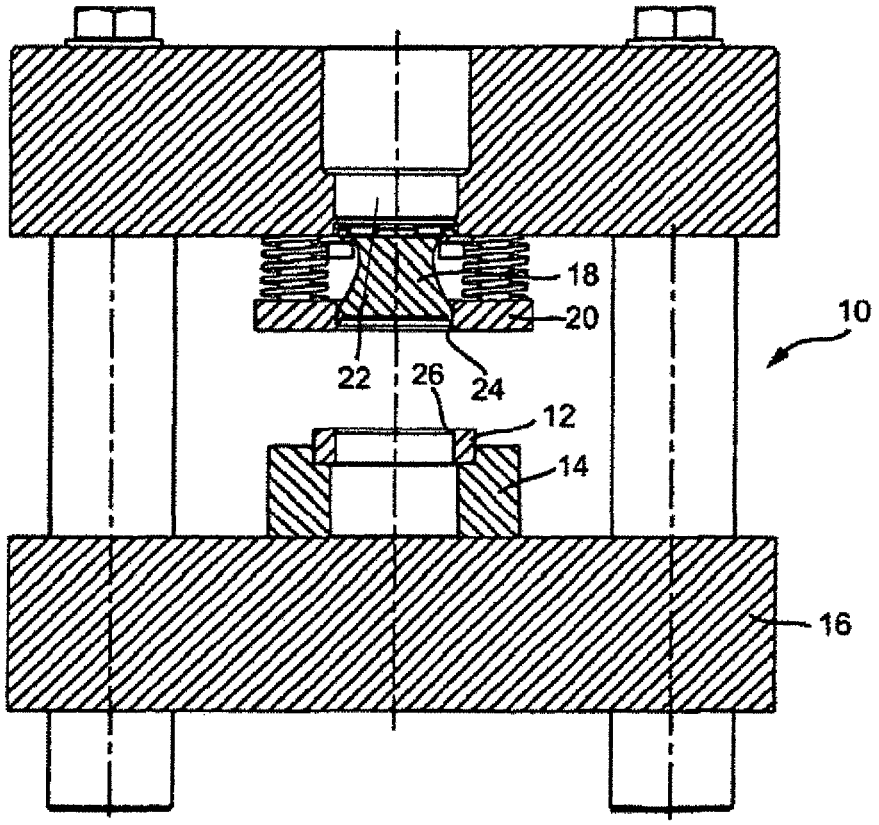
FIG. 1 shows a longitudinal section through a separating device in the open state.
Figure 2:
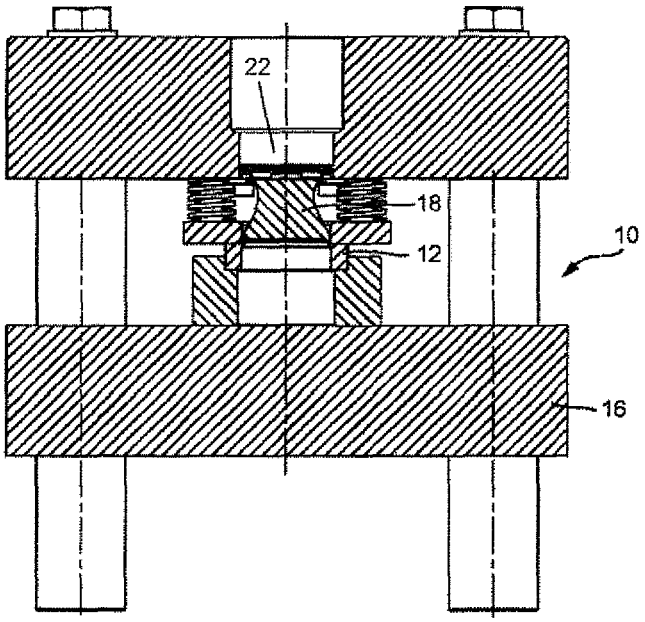
FIG. 2 shows a longitudinal section through the separating device in the closed state (shear cut)
Figure 3:
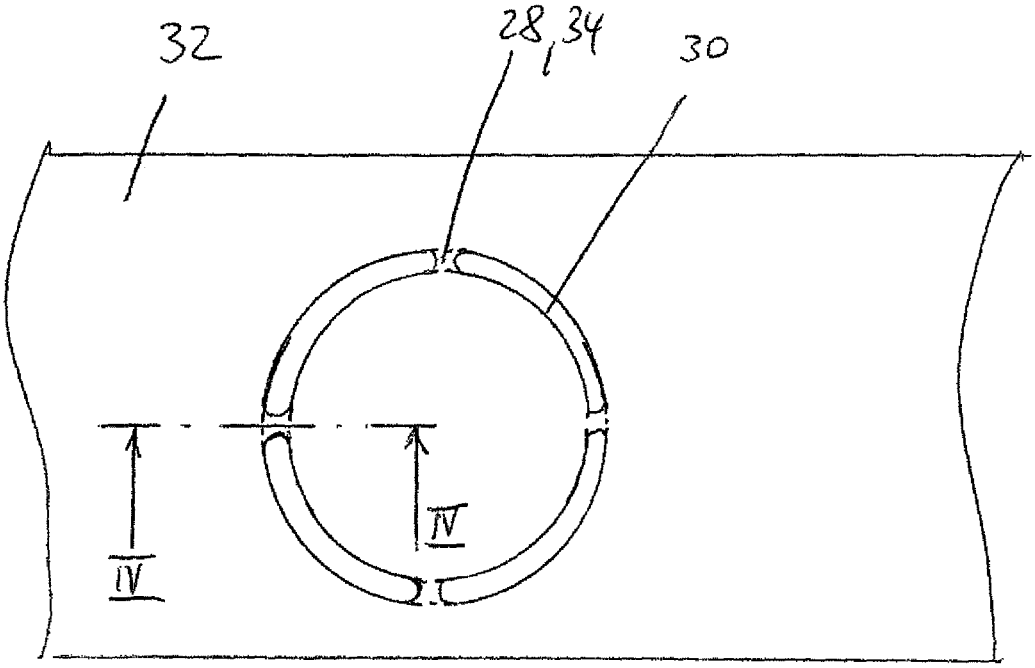
FIG. 3 shows an embodiment according to a first variant of a processing cut in a plan view.

The longitudinal section illustrated in the drawing shows a processing device, generally designated with 10, with a counter tool 12 (die), which is attached on a tool holder 14 and which can be moved vertically by a carriage 16. A processing tool 18, which is surrounded by a hold-down device 20 and has at the bottom side a cutting edge 24, is located opposite the counter tool 12. The processing tool 18 is supported by an ultrasonic sonotrode 22. The cutting edge 24 has spaced-apart cutting sections which can be used to produce a perforation cut. The dimensions of the cutting portions 30 (FIG. 3) are selected such that the cutting portions can move into the cutting contour 26 disposed in the counter tool 12 with a gap distance of a few 1/100 mm, as shown in FIG. 2. Here, the reciprocating movement of the carriage 16 is here superimposed on the ultrasonic movement of the processing tool 18. The material of the product 32 to be processed is thereby softened, thus substantially aiding with the cutting process. In addition, the cutting edges are rounded. lands 28 remain between the cutting sections on product 32 to be processed.

The processing tool 18 may also have a continuous cutting edge 24, with which the flat product 32, however, is separated only over a portion of the thickness. In both variants, the flat product 32 is embrittled 34 in the processing region, so that the processing region can then be easily broken apart by deformation.

Figure 4:
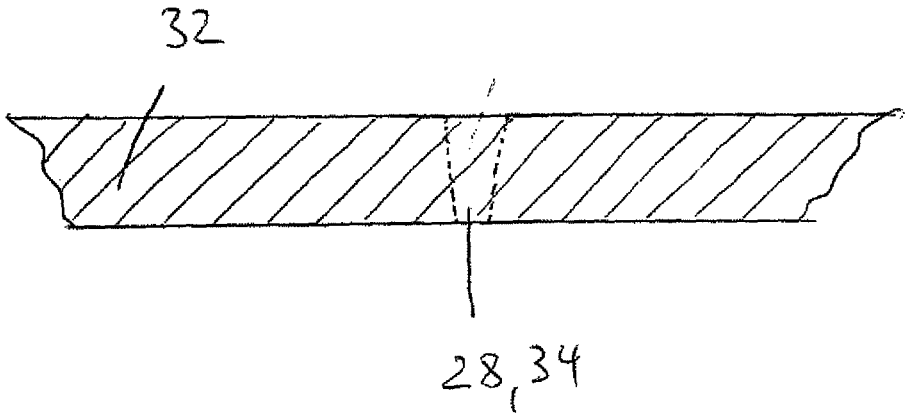
FIG. 4 shows the embodiment FIG. 3 in a cross-sectional view taken along the line IV-IV of FIG. 3.
Figure 5:
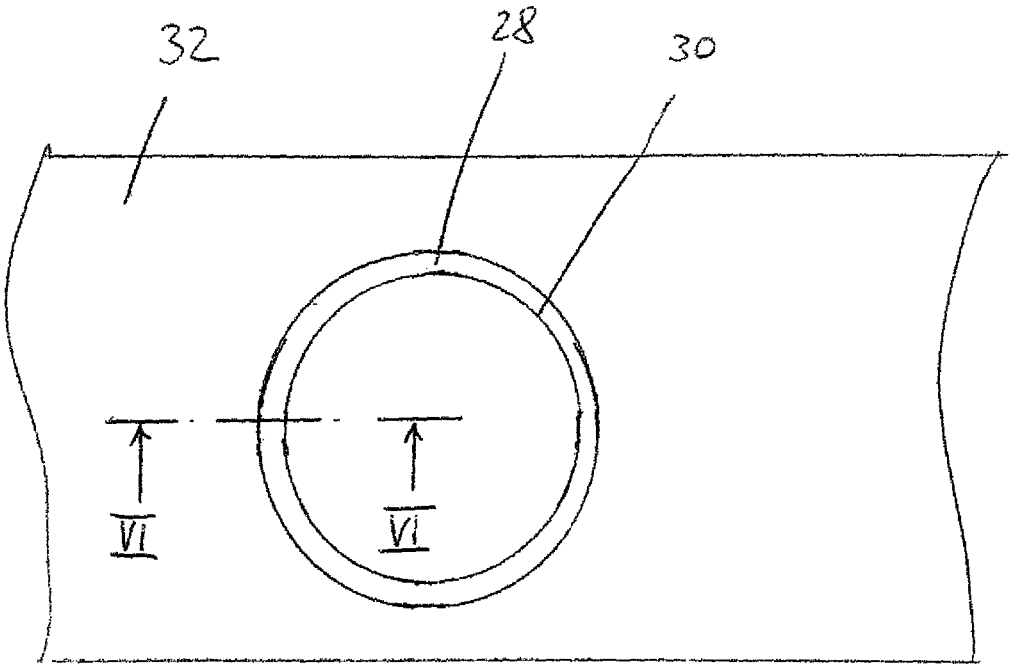
FIG. 5 shows an embodiment according to a second variant of the processing cut.
Figure 6:
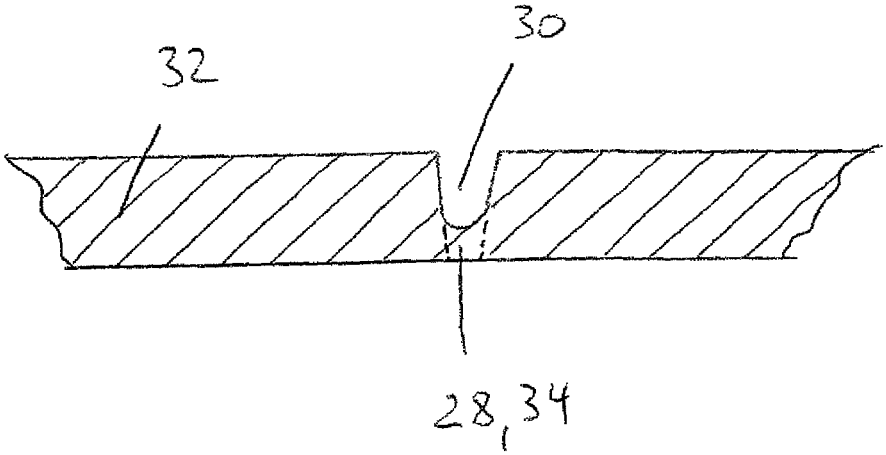
FIG. 6 shows the embodiment FIG. 5 in a cross-sectional view taken along the line VI-VI of FIG. 5.

The counter tool 12 may also be constructed with a closed surface, so that the processing tool 18 performs a crush cut (FIG. 4). Here, the closing movement of the carriage 16 ends before the counter tool 12 contacts the processing tool 18.

What is claimed is:

1. A method for processing or producing break lines in a flat product, comprising:

providing a sonotrode, a processing tool, and a counter tool;

supporting the processing tool by the sonotrode so that the processing tool together with the sonotrode performs an ultrasonic processing movement and arranging the sonotrode with the processing tool supported by it in opposition to the counter tool, with the processing tool and the sonotrode positioned on one side of the product and the counter tool positioned on an opposite side of the product;

moving the counter tool vertically in a reciprocating movement toward a region of the flat product so that the vertical reciprocating movement of the counter tool is superimposed on the ultrasonic processing movement of the processing tool and subjecting the region to an oscillating movement by the sonotrode in a direction which is parallel to the processing movement of the processing tool thereby embrittling the flat product in the region and allowing the flat product to be severed in the region.

2. The method of claim 1, further comprising at least one of perforating or kiss-cutting the flat product.

3. The method of claim 1, wherein the oscillating movement of the sonotrode has a stroke of 5 μm to 20 μm.

4. The method of claim 1, wherein the processing tool has a cutting edge with spaced-apart cutting sections configured to cut the flat product in sections, with lands remaining between separation locations and producing a perforating cut.

5. The method of claim 1, wherein the processing tool has a continuous cutting edge, and reduces a height of the flat product.

* * * * *